United States Patent [19]

Pokorny et al.

[11] 4,150,630

[45] Apr. 24, 1979

[54] PORTABLE STAGE

[76] Inventors: Joseph E. Pokorny, 500 Saylor Way, Las Vagas, Nev. 89107; Richard N. Keller, 2818 E. Tonopah, North Las Vegas, Nev. 89030

[21] Appl. No.: 855,739

[22] Filed: Nov. 29, 1977

Related U.S. Application Data

[63] Continuation-in-part of Ser. No. 774,676, Mar. 7, 1977, Pat. No. 4,064,814.

[51] Int. Cl.[2] ..... A47B 57/00

[52] U.S. Cl. ..... 108/64; 108/90; 108/114

[58] Field of Search ..... 108/19, 64, 90, 114; 248/188.6; 52/6, 7, 623

[56] References Cited

U.S. PATENT DOCUMENTS

| | | | |
|---|---|---|---|
| 2,508,627 | 5/1950 | Spiegel et al. | 108/19 |
| 2,836,475 | 5/1958 | Sapp | 108/64 |
| 3,421,459 | 1/1969 | Sherwood | 108/64 X |
| 3,554,140 | 1/1971 | Homesberger | 108/90 |
| 3,968,606 | 7/1976 | Facemire | 108/90 |

*Primary Examiner*—James C. Mitchell
*Attorney, Agent, or Firm*—Seiler & Quirk

[57] ABSTRACT

A portable stage is formed from a plurality of similar interlocking members having interconnecting fastening mechanisms located on the ends and sides of the stage top. Each member has a removable upper surface panel, and a plurality of foldable legs of at least two different lengths.

7 Claims, 5 Drawing Figures

PORTABLE STAGE

CROSS REFERENCE TO RELATED APPLICATIONS

This application is a continuation-in-part of application Ser. No. 774,676, filed Mar. 7, 1977, entitled "Self-Leveling Extendable Table", now U.S. Pat. No. 4,064,814, issued Dec. 27, 1977.

BACKGROUND OF THE INVENTION

The need for temporary stage or platform facilities arises on many occasions. Raised platforms may be used for parties, temporary show facilities, school dances, parties in private homes, and on many other occasions where it is desirable to elevate an entertainment or eductional performance, such as a speaker, musical group, or the like. In the past, most temporary stage facilities were built in specific sizes on the expectation that the entertainer or speaker could adjust his needs to fit the available stage size. Most portable stages were undesirably small, since large stages were quite difficult to move and store. In some cases, a plurality of small stages were pushed together in an effort to form a single large stage; however, the result was an unstable stage having separations and/or uneven levels between the various stage sections. This situation could result in great danger to an entertainer in tripping and falling, with large potential liability to the proprietor of the property.

Another problem existing in stages of the prior art concerns the wearing of the stage surface. Portable platforms are subject to heavy wear from use and in movement from place to place. Gouges, chips, and scratches inflicted on the upper surface by heavy musical or sound equipment, dancers, and the like, along with impacts incurred during the transfer of stages into and out from storage create rapid deterioration of the upper surface. On previous stages, repair of the stage surface is more difficult and costly than building a new stage; therefore, it has been common to attempt to patch such imperfections in the hopes of increasing the useful life of the stage. The alternative to repairing the upper surface has been to discard the whole stage unit.

Another problem associated with stages of the prior art has been the practical adjustment of the height of the stages for various uses. Portable stages are generally constructed without height adjustability, and units have been stacked, or have been set on bricks, blocks, or other structural supports in an effort to increase their height from ground level. Stages with telescoping legs have generally been difficult to adjust to a perfect horizontal position, and have been prone to failure under heavy use. In addition, when more than one stage member having adjustable legs has been used in side-to-side fashion, problems have been encountered in adjusting both stages to the same height.

It is therefore an object of the present invention to provide a stage which may be fabricated from a plurality of portable interlocking units, thereby providing a single level stage surface of variable size and shape. It is a further object of the invention to provide a stage unit which may be used as a building block to form a large stage with other stage units, each stage unit having interconnecting locking means to fasten the ends and sides of the unit to the ends and sides, respectively, of other identical units.

It is a further object of the invention to provide a stage unit having a plurality of support members, including two independent support member systems of differing heights.

It is still a further object of the invention to provide an interconnecting stage unit having a replaceable upper floor surface.

These and other objects of the invention will be apparent to one skilled in the art from the following detailed description of a specific embodiment of the invention.

SUMMARY OF THE INVENTION

A stage unit capable of interlocking with like units to form a larger stage comprises a rectangular frame having two sides and two ends, a flat rigid floor supported by the frame, fastening means at the end of the frame for removably engaging interconnecting fastening means at an end of a like adjacent stage unit, fastening means at each side of the frame for removably engaging interconnecting fastening means at a side of a like adjacent stage unit, and support means for maintaining the floor in a raised horizontal postition.

BRIEF DESCRIPTION OF THE DRAWINGS

The invention is better understood with reference to the drawings in which.

DETAILED DESCRIPTION OF THE INVENTION

Figure 1:
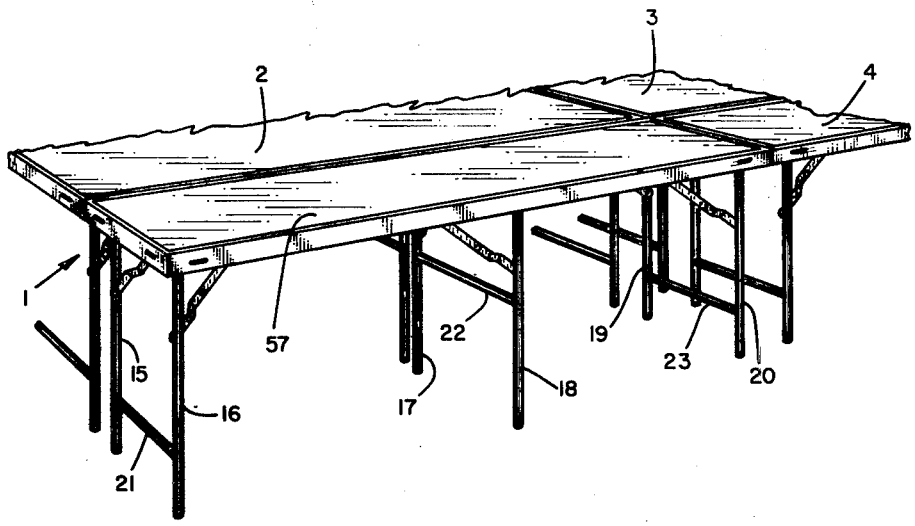
FIG. 1 is a perspective view of a table unit of the invention, with partial views of three interconnected similar units.

Referring to the drawings, FIG. 1 shows stage unit 1 mounted in upright position and attached to adjacent identical stage units 2, 3, and 4. Each unit has a peripheral sheet metal frame 5 having side edges 6 and 7 and ends 8 and 9, and having an inwardly extending perpendicular ledge 10 for supporting the floor of the stage. Each stage unit is approximately two feet wide by eight feet long, although of course larger or smaller units, which may be square or oblong, can be used.

Each stage unit is supported by a series of retractable legs. In the preferred embodiment shown in the drawings, each stage unit has three sets of long legs which support the stage floor at a height of approximately 2 ½ feet above the ground, and three sets of shorter legs which alternatively support the stage floor at a height of about 1'3". In FIG. 1, legs 15, 16, 17, 18, 19, and 20 are shown in the extended or supportive position. Each pair of legs is separated by a cross brace identified as 21, 22, and 23, for maintaining the strength and stability of the stage. Shorter leg members 25, 26, 27, 28, 29, and 30 are separated by cross braces 31, 32, and 33. Each leg is fabricated from 1 inch diameter tubular zinc-plated carbon steel, and terminates in a smooth foot 35, which is pressed into the bottom of the hollow tube. The feet are conventional heavy-duty non-swivel glide line, such as the R. C. Silencer model manufactured by Plastiglide Manufacturing Corporation of Santa Monica, California. Each set of legs is welded to a top cross member, indicated in FIG. 2 as 36, 37, and 38 for the longer legs and 39, 40, and 41 for the shorter legs. These cross members are also tubular steel, and are slightly longer than the width of the leg pairs to permit fastening of each set of legs to the under side of the bottom platform member. The cross pieces are attached to the underside of the stage by clamps 45, which are fastened to the base by machine screws and permit rotation of the cross members, thereby allowing each pair of legs to rotate from a retracted position shown in FIG. 2 to an extended position shown in FIG. 1. A more detailed view of the clamps 45, also showing the path traveled by the leg pairs from the retracted to the extended position, is shown in FIG. 4.

Figure 5:
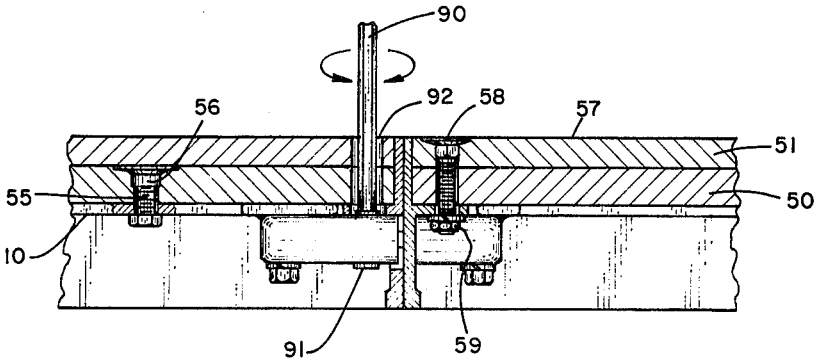
FIG. 5 is a partial section view of the stage top, showing the operation of the locking mechanisms, and also illustrating the means for attachment for the removable stage floor.

The stage platform consists of two rigid pieces of plywood 50 and 51. Plywood member 50 serves as a base for the stage surface, and is permanently bolted to the frame by Phillips-head screws 55 (see FIG. 5) which extend through holes in the base member and through corresponding holes in ledge 10. The screws are secured to the frame with T-nuts 56; in most cases, only two screws on each side of the stage unit are required to secure the base member to the frame. Both top and bottom platform members are made from plywood, the top being $\frac{3}{8}''$ and the bottom $\frac{1}{2}''$ in thickness.

Upper platform member 51 has an upper surface 57 which serves as the surface of the stage. In use, the upper platform member is bolted to the frame by bolts 58 which are secured to the frame ledge 10 with nuts 59. In each case, the head of the bolt is countersunk into the plywood to provide a level surface for each platform member. Three bolts are used on each end of the stage unit, and six bolts are used along each side. For simplicity, most of the bolts have not been shown on the drawings.

Figure 2:
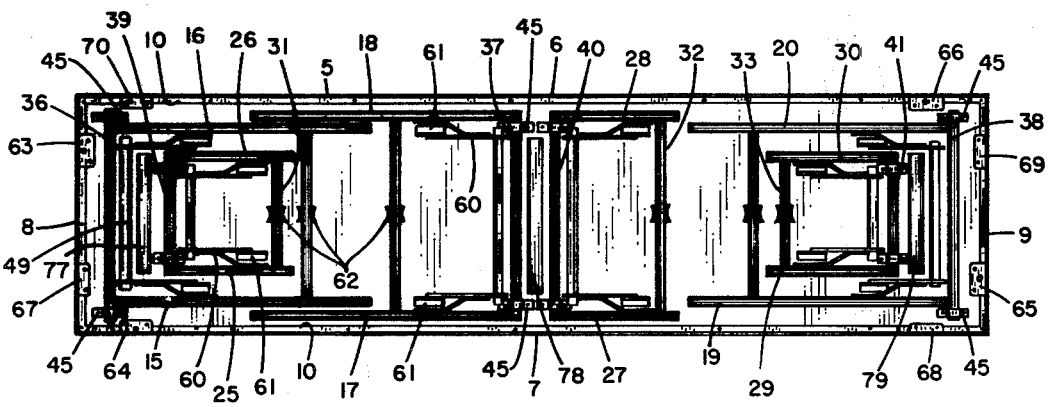
FIG. 2 is a bottom view of the table with all of the legs in retracted position.
Figure 4:
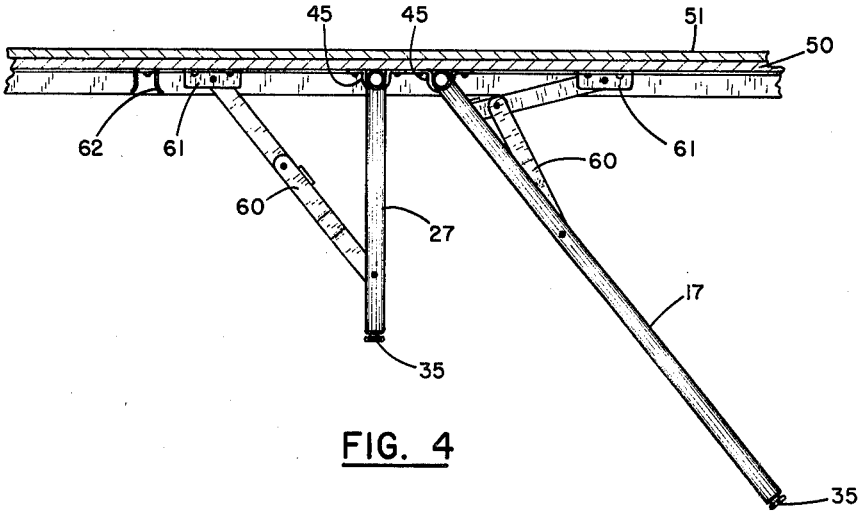
FIG. 4 is a partial section side view of a stage unit showing the short legs in fully extended positon and the long legs in partially extended position.

The stage legs are attached directly to the underside of platform base 50 as shown in FIGS. 2 and 4. Each pair of legs swings from an extended position to a retracted position, the latter being shown in FIG. 2. Leg 17 is shown in a partially retracted position in FIG. 4. Rotation of the leg member between the retracted and extended positions is controlled by conventional hinge 60, which is rotatably fastened to each leg and to the bottom surface of platform base 50 by means of bracket 61. The bracket is a small angle iron segment having a horizontal flange screwed to base 50 and a downwardly depending vertical flange pivotally attached to the hinge. The leg members are retained in the retracted position when not in use by biased clips 62 which receive the cross brace between the legs.

Figure 3:
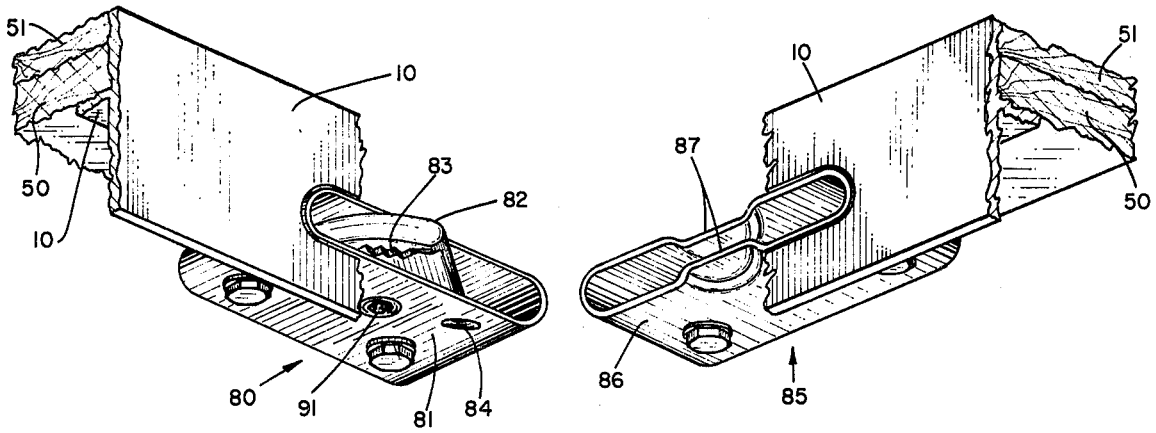
FIG. 3 is a partial section view of the male and female parts of a fastening device used to fasten the stage units together.

One of the most significant features of the stage of the invention is the ability to interconnect each stage unit with other identical units to form a complete stage of desirable dimensions, while still retaining the strength and stability of a unitary stage. This ability is provided by certain male/female blocks located on the sides and ends of each unit which mate with interconnecting members on other units to prevent horizontal or vertical movement of the stage units relative to each other when they are locked in place. In the preferred aspect of the invention, each end and each side of each unit has both a male and a female portion of a lock attached thereto. As shown in FIG. 2, male lock parts 63, 64, 65, and 66 are carried respectively by frame edges 8, 7, 9, and 6. Similarly, female lock parts 67, 68, 69, and 70 are located on each side of the frame such that when placed adjacent to an identical unit, the male and female parts would interlock. Perspective views of the male and female parts of a preferred locking device are shown in FIG. 3. The illustrated parts are commercial fasteners manufactured by Simmons Fastener Corporation, Albany, New York, Model B-1311. These devices are heavy duty latches which do not protrude from the sides of the table when in their inactive positions. As shown in FIG. 3 male part 80 consists of a housing 81 containing semi-circular latch wheel 82 eccentrically mounted through apertures in the housing. Ratchet mechanism 83 on the bottom of the latch wheel frictionally engages ridge 84 on the lower internal surface of housing 81, and a corresponding ratchet on the upper surface of the latch wheel (not shown) engages a similar indentation on the upper internal surface of the housing, requiring substantial torque to be applied to rotate the wheel in the housing. This prevents free movement and unintentional loosening of the latch, and allows the wheel to lock into place when it has engaged the female part. Torque is applied by means of a removable handle having a hexagonal shaft or an Allen wrench 90 (see FIG. 5) which fits a receiving well 91 in the housing. The well is accessible either from the bottom of the stage unit or through bores 92 through platforms 50 and 51.

The female parts 85 of the latch consists simply of housing 86 with semi-circular indentation 87 in the open front of the housing. In operation, as the wrench is turned in male part 80, the leading edge of the latch wheel emerges from housing 81 as shown in FIG. 3. The wheel is mounted eccentrically such that the distance from the center of rotation of the wheel to the periphery of the wheel is the maximum at the leading edge and becomes progressively shorter as the wheel is turned. The leading edge engages the indentation 87 of the female latch part, with the raised periphery of the male part passing behind the indentation. As the wheel is turned, the effective radius of the periphery becomes increasingly shorter, urging the female part toward the male part until a lock is obtained. The lock is released by reversing the rotation of the wheel.

Additional strengthening features may also be used to insure stability of the stage; for example angle iron ribs 49 extend between each pair of hinges. In addition, wood members 77, 78, and 79 are screwed and glued to the bottom of platform base 50 to provide protection for the folded legs when the tables are stacked for storage. The wood braces are approximately $1\frac{1}{2}''$ square in cross section, and are from 12" to 16" in length.

When the table is in storage, all of the legs are folded in the retracted position, and the total stage has a width of only about $2\frac{1}{4}''$. In preparation for use, the legs of the desired length are unfolded to the extended position, and the unit is placed in position adjacent to other stage units as shown in FIG. 1. By means of an Allen wrench, the male and female latch parts carried by each frame are locked into position with the corresponding latch parts of the adjacent state unit. The procedure is reversed for disassembly and storage.

While the invention has been described with an example of the best mode thereof known to the inventors, it will be understood that the description is intended to be illustrative rather than restrictive. Many changes, omissions, or additions can be made with respect to the preferred embodiment shown without departure from the scope of the invention, which should be limited only by the following claims.

I claim:

1. A portable stage unit capable of interlocking with other like units to form a raised stage platform comprises a rectangular frame having two sides and two ends, a flat, rigid floor supported by the frame, said flat rigid floor comprising a first flat, rigid member and a second flat, rigid floor member located immediately adjacent said first member, fastening means for attaching said first and second floor members to the unit, fastening means at each end of the frame for removably engaging interconnecting fastening means at an end of a like adjacent stage unit, fastening means at each side of the frame for removably engaging interconnecting fastening means at a side of a like adjacent stage unit, support means for maintaining the floor in a raised, horizontal position comprising a plurality of legs of a first length, and a plurality of legs of a second length, all of the legs being movable between an extended position and a retracted position to permit selective use of legs of either length.

2. The stage unit of claim 1 wherein the fastening means at each side of the frame comprises a first latch means and a second latch means for engaging interconnecting first and second latch means at a side of a like adjacent stage unit.

3. The stage unit of claim 1 wherein the fastening means at each side of the frame comprises a male part and a female part of fastening means, the male parts being located on diagonally opposing sides of the ends of the top such that a like stage unit having similarly arranged fastening means may be locked into position adjacent to the unit.

4. The portable stage unit of claim 1 wherein the first and second floor members each have upper and lower flat surfaces, and the upper surface of the first member is adjacent to and substantially coextensive with the lower surface of the second member.

5. In a portable stage unit capable of interlocking with other like units to form a raised stage platform, the unit having support means for elevating the surface of the stage above ground level, and having a frame which supports a flat, rigid floor, parallel to and above the ground, the improvement therein which comprises a first structural flat rigid floor member, fastening means for attaching said first member to the frame, a second structural flat rigid floor member independently fastened to said stage unit, said second member being located immediately adjacent to and sharing a common perimeter with said first unit, second fastening means for removably attaching the second member to the stage unit, a plurality of legs of a first length, a plurality of legs of a second length, and means for moving the legs between an extended position and a retracted position to permit selective use of legs of either length.

6. The improvement of claim 5 wherein the first and second floor members each have an upper and lower flat surface, and the upper surface of the first member is adjacent to and substantially coextensive with the lower surface of the second member.

7. The portable stage unit of claim 1 having first fastening means for attaching said first floor member to the frame, and second fastening means for independently attaching said second floor member to the frame.

* * * * *